US007775328B2

(12) United States Patent
Robledo Barrio et al.

(10) Patent No.: US 7,775,328 B2
(45) Date of Patent: Aug. 17, 2010

(54) OPERATION DEVICE FOR AN ELEVATOR SYSTEM

(75) Inventors: Rodolfo Robledo Barrio, Berlin (DE); Jürgen Gewinner, Berlin (DE)

(73) Assignee: Otis Elevator Company, Farmington, CT (US)

( * ) Notice: Subject to any disclaimer, the term of this patent is extended or adjusted under 35 U.S.C. 154(b) by 579 days.

(21) Appl. No.: 11/813,232

(22) PCT Filed: Jan. 13, 2005

(86) PCT No.: PCT/EP2005/000281

§ 371 (c)(1),
(2), (4) Date: Jul. 2, 2007

(87) PCT Pub. No.: WO2006/074696

PCT Pub. Date: Jul. 20, 2006

(65) Prior Publication Data

US 2008/0000726 A1 Jan. 3, 2008

(51) Int. Cl.
*B66B 1/06* (2006.01)

(52) U.S. Cl. ..... 187/290; 187/296

(58) Field of Classification Search ..... 187/277, 187/289, 290, 294, 296, 297; 318/807–811, 318/376; 307/64–66
See application file for complete search history.

(56) References Cited

U.S. PATENT DOCUMENTS 4,316,097 A 2/1982 Reynolds
4,484,664 A * 11/1984 Nomura ..... 187/290
4,666,020 A * 5/1987 Watanabe ..... 187/290
5,058,710 A 10/1991 Iwasa
5,285,029 A 2/1994 Araki
5,945,644 A 8/1999 Jang
6,315,081 B1 * 11/2001 Yeo ..... 187/290
6,481,533 B1 * 11/2002 Iwasa ..... 187/296
6,827,182 B2 * 12/2004 Araki ..... 187/290
7,275,622 B2 * 10/2007 Hall et al. ..... 187/290
7,650,968 B2 * 1/2010 Oesterle et al. ..... 187/290
2008/0073157 A1 * 3/2008 Kanon et al. ..... 187/290

FOREIGN PATENT DOCUMENTS

EP 1286455 A1 2/2003
JP 9255254 A 9/1997

* cited by examiner

*Primary Examiner*—Jonathan Salata
(74) *Attorney, Agent, or Firm*—Carlson, Gaskey & Olds PC

(57) ABSTRACT

An operation device for an elevator system includes terminals connectable to a 3-phase AC power source providing a respective AC power supply voltage and a drive device connected to the terminals for driving a motor of the elevator system. A transformer is connected to at least two of the terminals and provides at least one supply voltage to the remainder of the elevator system. In an emergency operation of the elevator system, an auxiliary power supply having an output providing an auxiliary output voltage is connected to the transformer for generating an auxiliary supply voltage provided to the drive device via the transformer.

18 Claims, 2 Drawing Sheets

OPERATION DEVICE FOR AN ELEVATOR SYSTEM

CROSS REFERENCE TO RELATED APPLICATIONS

This application claims priority to International Application No. PCT/EP2005/000281, which was filed on 13 Jan. 2005.

BACKGROUND OF THE INVENTION

The present invention is directed to an operation device for an elevator system comprising terminals for connection to a 3-phase AC power source providing a respective AC power supply voltage and a drive device connected to the terminals for driving a motor of the elevator system. More particularly, the invention relates to improvements in an operation device for an elevator system which is designed to operate in normal operation and in an emergency operation of the elevator system.

It is known to provide a source of emergency power for operating elevators when a power source such as a normal building power source fails. The emergency power is supplied, for example, by supplementary generators to provide an auxiliary power supply for running the elevator system in an emergency operation during the power failure. In particular, a suitable operation device which operates the elevator system in an emergency operation must provide a possibility to move the elevator car to a suitable floor when the elevator car stops e.g. between floors because of the power failure.

In U.S. Pat. No. 4,484,664 an emergency drive device for an elevator is described, wherein the elevator operated by an AC motor may be driven in an emergency as during a power supply interruption. During a power supply interruption of a 3-phase power source, the DC output from a rectifier fed to an inverter disappears and an emergency power source becomes operative to supply DC power to the inverter used for converting a constant DC voltage into an AC voltage having desired magnitude and frequency for driving the motor of the elevator system. The emergency power source is connected in series with a diode forming a circuit which is connected across input terminals of the DC/AC inverter. The direct current of the emergency power source is converted into an alternating current of predetermined frequency to drive the elevator motor to cause the elevator car to travel at a lower speed to the nearby floor. In the situation when the car travels down with a heavy load, the kinetic energy is not returned to the DC side, but is consumed at the rotor of the motor. This requires special control logic for controlling the respective transistors of the inverter.

U.S. Pat. No. 5,945,644 A is directed to an apparatus and a method for controlling emergency operation in an elevator system. An auxiliary system is provided to guide an elevator car to the nearest floor for a safe rescue of passengers in case of a stop of the elevator car because of an electrical power failure during operation. The auxiliary system is powered by a battery and serves to convert a direct current voltage of the battery in an alternating current voltage, which is in turn supplied to the elevator system, thereby enabling the passengers aboard the elevator car to be safely rescued. According to a conventional emergency control apparatus described therein, when an emergency situation occurs such as a power failure an emergency power supply is provided by converting the direct current voltage outputted from the battery into a 3-phase alternating current voltage. The converted voltage is provided to a rectifier rectifying the 3-phase alternating current voltage into a direct current voltage which is supplied to an inverter, the inverter converting the received direct current voltage into alternating current voltages for feeding an induction motor. Moreover, the converted 3-phase alternating current voltage of the emergency power supply is provided to a transformer providing a supply voltage to a control circuit for controlling the inverter in the same way as when the supply voltage outputted from the 3-phase power source is provided. The emergency power supply is required to generate a full-swing 3-phase alternating current voltage equal to that of the 3-phase power source.

It is an object of the present invention to provide an operation device for an elevator system which can be integrated into an existing operation device design and which requires only slight circuit modifications.

SUMMARY OF THE INVENTION

This object is solved by an operation device for an elevator system according to claim 1.

The operation device for an elevator system according to the invention comprises terminals connectable to a 3-phase AC power source for receiving a respective AC power supply voltage for driving a motor of the elevator system, and a drive device connected to the terminals. A transformer is connected to at least two of the terminals, the transformer adapted to provide at least one supply voltage to the remainder of the elevator system. The operation device further comprises an auxiliary power supply having an output providing an auxiliary output voltage, wherein the auxiliary power supply output is connectable, in an emergency operation of the elevator system, to the transformer for generating an auxiliary supply voltage provided to the drive device via the transformer. Thus, according to the invention, in an emergency operation of the elevator system, the drive device for driving the motor of the elevator system is supplied with alternating current voltage from the transformer, which is e.g. an existing main transformer used to generate all needed voltages for the elevator system in normal and emergency operation. As a result, the auxiliary system according to the invention is applicable to guide an elevator car to the nearest floor for a safe rescue of the passengers in case of an electrical power failure during operation.

According to an embodiment of the invention, the auxiliary power supply comprises a battery-fed DC/AC inverter to supply the transformer for generating all needed voltages to run the elevator system in an emergency operation. The DC/AC inverter may have a modified or a true sine wave output depending on the demands of the driving system. The output voltage of the DC/AC inverter may be selectable in magnitude, e.g. between 110 V and 400 V, depending on the demands of the installation.

According to a further embodiment of the invention, the transformer is connected to respective two of the terminals connectable to the 3-phase AC power source for receiving a 2-phase voltage. Accordingly, the auxiliary power supply has an output which provides a 2-phase auxiliary output voltage, wherein the output is connectable, in emergency operation of the elevator system, to the transformer for generating a 2-phase auxiliary supply voltage provided to the drive device via the transformer.

Advantageously, the auxiliary supply voltage provided to the drive device is higher in magnitude than the auxiliary output voltage of the auxiliary power supply. For example, the auxiliary power supply provides an auxiliary output voltage of 230 V which is stepped-up to an auxiliary supply voltage of 400 V provided to the drive device.

In particular, the transformer has a primary and a secondary winding, the primary winding being adapted to be connected to the 3-phase AC power source and the secondary winding being adapted to provide at least the supply voltage to the remainder of the elevator system. The auxiliary power supply output is connected, in emergency operation of the elevator system, to the primary winding of the transformer in order to generate the auxiliary supply voltage provided to the drive device via the primary winding of the transformer.

To achieve the above-mentioned effect of a stepped-up auxiliary supply voltage, the primary winding of the transformer advantageously has a first and a second tapping. The first tapping is connected to the terminals for connection to the 3-phase AC power source. The auxiliary power supply output is connected, in emergency operation of the elevator system, to the second tapping to generate the auxiliary supply voltage provided to the drive device via the first tapping. For example, the second tapping of the transformer receives an auxiliary output voltage of e.g. 230 V, wherein the first tapping provides an auxiliary supply voltage to the drive device of e.g. 400 V.

In a further embodiment of the present invention, the elevator system comprises a door operating device for operating a door of an elevator car which is also supplied by the auxiliary power supply in an emergency operation of the elevator system. To this end, the door operating device is connected to the auxiliary power supply output for receiving the auxiliary output voltage of the auxiliary power supply. For example, the door operating device is operable at 230 V directly supplied by the auxiliary power supply output, whereas the drive device is supplied with an auxiliary supply voltage of 400 V provided via the transformer. As such, the primary winding of the transformer has a first tapping for 400 V and a second tapping for 230 V, wherein the door operating device and the second tapping of the transformer are supplied with 230 V from the auxiliary power supply and the drive device is supplied with a stepped-up voltage of 400 V via the first tapping of the transformer.

Further advantages, features, aspects, embodiments and details of the invention are evident from the dependent claims.

The invention will be better understood by reference to the following description of embodiments of the invention taken in conjunction with the accompanying drawings, wherein

DETAILED DESCRIPTION

Figure 1:
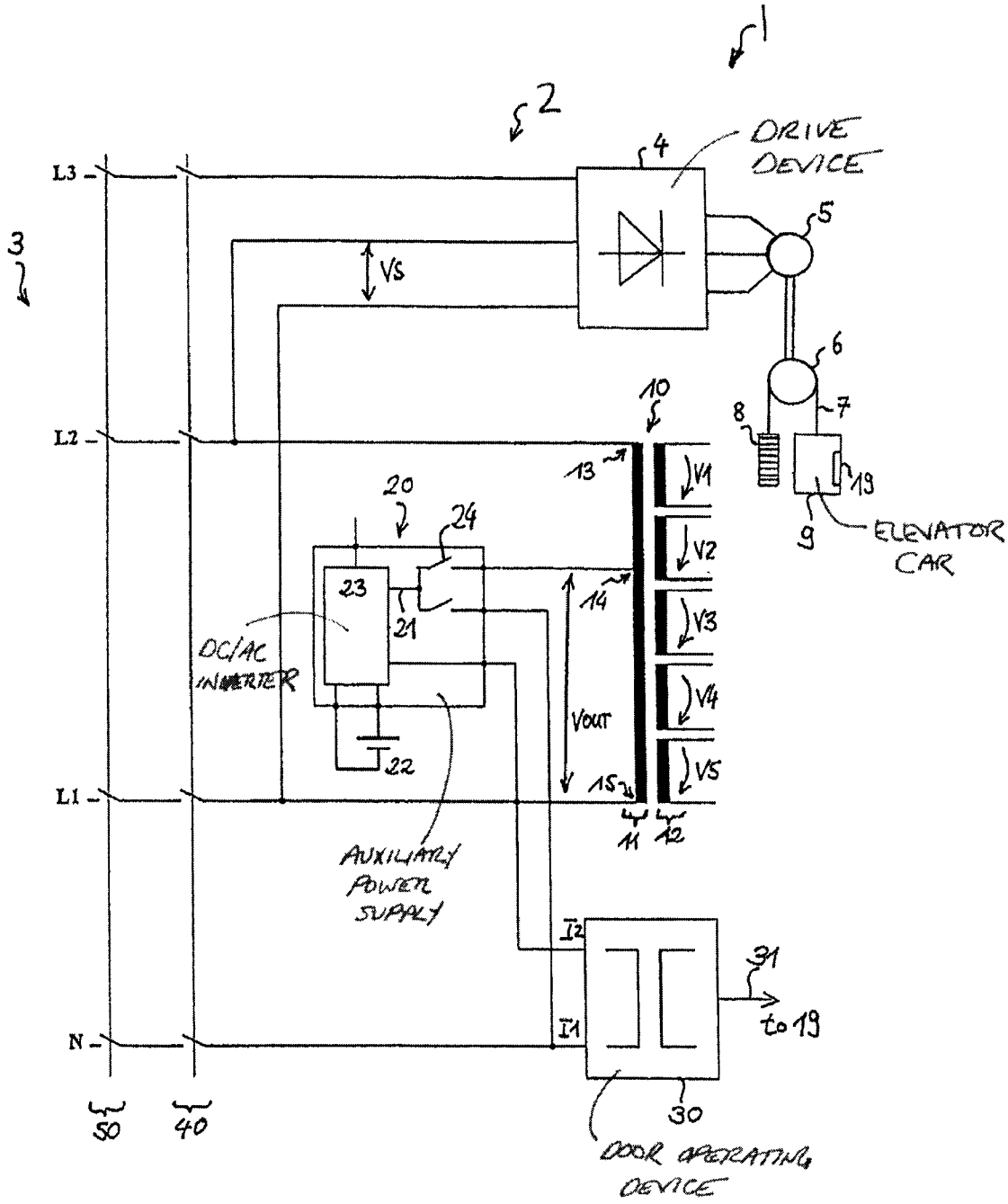
FIG. 1 shows a circuit diagram of an embodiment of the operating device for an elevator system according to the present invention.

With reference now to the drawings, and in particular to FIG. 1, an operation device 2 for an elevator system 1 comprises terminals L1, L2, L3, and N connected to a 3-phase AC power source 3 providing a respective AC power supply voltage. A drive device 4 is connected to the first, second and third terminals L1, L2, L3 and therefore to the 3-phase AC power source 3 through a main switch 50 and an emergency switching device 40 for receiving an alternating current voltage from the power source 3 via respective input conductors. These input conductors transmit this power to a 3-phase power rectifier which is included in the drive device 4 according to FIG. 1. In FIG. 1, the drive device 4 is shown in schematic view as a block representing a typical converter circuit including a rectifier for rectifying 3-phase AC input voltage to a DC voltage and for supplying the resulting DC potential to a DC/AC inverter. Such inverter comprises a plurality of pairs of series-connected switching elements to generate an output having an adjustable frequency. Such inverter is operable to drive an AC motor 5 at a variable speed.

In FIG. 1, there is illustrated a common elevator system comprising e.g. a 3-phase induction motor 5 which is mechanically connected to a sheave 6 of a hoist, which is driven by the motor 5. A length of a traction cable 7 is trained over the sheave 6 and connected at one end to an elevator car 9 and at an other end to a balance weight 8.

The operation device 2 according to FIG. 1 further comprises a transformer 10 connected to first and second terminals L1 and L2 connected to the 3-phase AC power source 3. The transformer 10 serves to provide supply voltages V1 to V5 to the remainder of the elevator system 1 such as control circuits for controlling the drive device 4, speed detectors, light systems to supply the elevator car with light, or the like. Transformer 10 has a primary winding 11 and, according to the present embodiment, five secondary windings 12, each of them providing respective one of the voltages V1 to V5. The primary winding 11 is connected to first and second terminals L1 and L2 and the secondary windings 12 are connected to the respective subsystems of the elevator system which are not shown in FIG. 1 for simplicity purposes.

The primary winding 11 of the transformer 10 has a first tapping 13-15 comprising a first tap 13 and a terminal 15 and a second tapping 14-15 comprising a second tap 14 and terminal 15. For example, the first tapping 13-15 is designed to receive an alternating current voltage of 400 V, whereas the second tapping 14-15 is designed to receive an alternating current voltage of 230V. The first tapping 13-15 of the primary winding 11 is used in normal operation of the elevator system to receive a respective alternating current voltage from the 3-phase AC power source 3 via terminals L1 and L2.

According to the invention, an auxiliary power supply 20 is connected to the second tap 14 of the primary winding 11 of transformer 10 and to the first terminal L1. The auxiliary power supply 20 comprises an output 21 providing an auxiliary output voltage VOUT supplied to the second tap 14 of the primary winding 11 of transformer 10. In particular, auxiliary power supply output 21 is connected to the second tap 14 in emergency operation of the elevator system when the 3-phase AC power source 3 fails to operate so that a power failure occurs across terminals L1, L2, L3 and N. In emergency operation, an auxiliary operation switch 24 is closed so as to connect DC/AC inverter 23 to the second tap 14 of the primary winding 11 of transformer 10. Inverter 23 is a battery-fed DC/AC inverter connected to battery 22, which acts as auxiliary power source to run the elevator system in emergency operation. Battery 22 may comprise, e.g., appropriate capacitors (so-called supercaps) or fuel cells.

Figure 2:
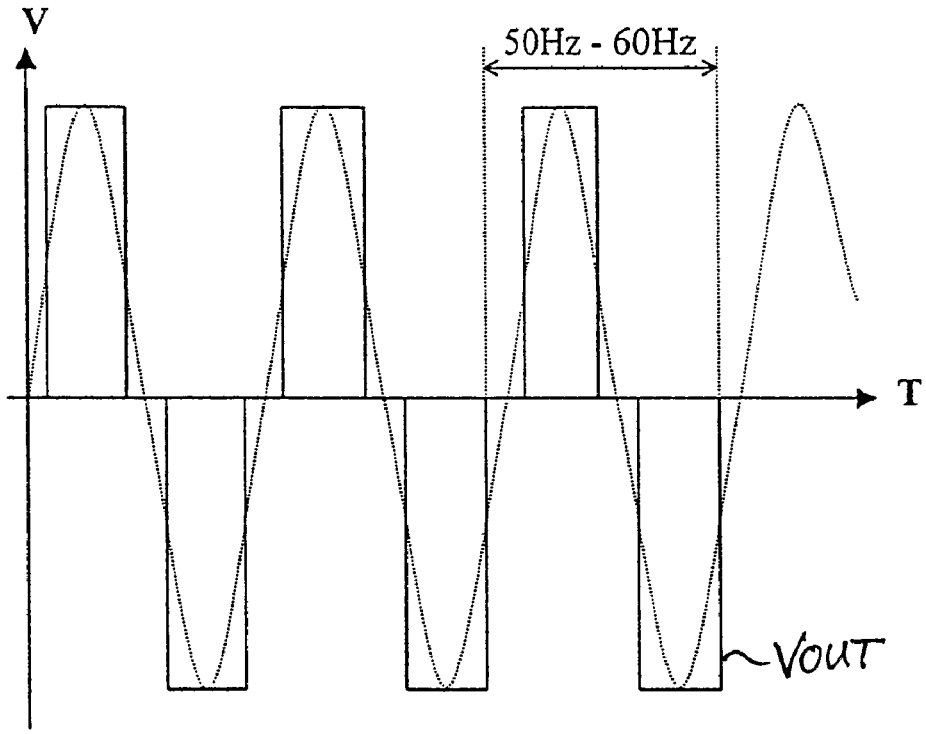
FIG. 2 shows a signal output diagram of an embodiment of an auxiliary power supply comprising a battery-fed DC/AC inverter.
Figure 2:
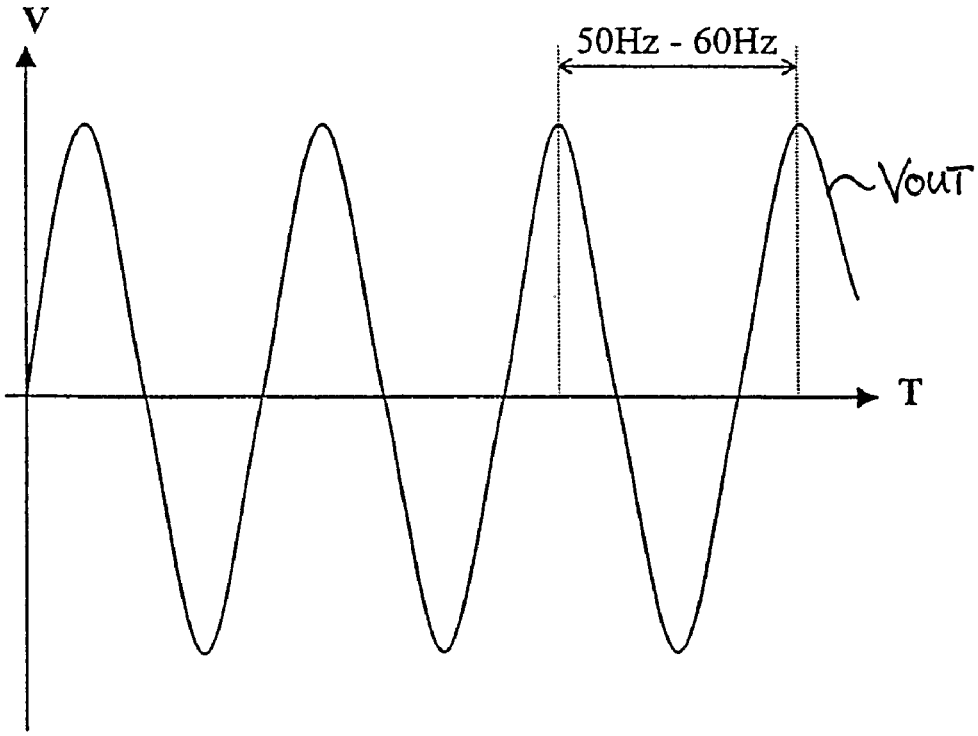

The auxiliary power supply 20 is designed to provide a modified or a true sine wave output voltage VOUT, such as shown in FIG. 2. According to the upper part of FIG. 2, the DC/AC inverter 23 is designed to output a modified sine wave in the form of a rectangular wave of VOUT with a frequency of 50 to 60 Hz. According to the signal output diagram in the lower part of FIG. 2, the DC/AC inverter 23 is designed to provide a true sine wave output voltage VOUT of the same frequency. The appropriate design of the DC/AC inverter 23 is chosen depending on the demands of the particular elevator system. Moreover, according to a preferred embodiment, the auxiliary power supply 20 is designed such that the auxiliary output voltage VOUT is selectable in magnitude, e.g. in steps 110 V, 230 V, 400 V and so on. According to the circuit of FIG. 1, the auxiliary output voltage VOUT of the inverter 23 is galvanically isolated from the battery 22 by the opened auxiliary operation switch 24 during normal operation of the elevator system.

According to an embodiment of the invention, the contacting elements of auxiliary operation switch 24 are auxiliary contacts of emergency switching device 40. By means of mechanical coupling or compulsory electrical coupling of switch 24 and switching device 40 it is assured that switch 24 is only closed when the operation device 2 has been actually discoupled from 3-phase AC power source by switching device 40. Otherwise, the 3-phase supply voltage may be supplied to the auxiliary power supply which might cause a destruction of the auxiliary power supply.

The emergency switching device 40 may be actuated in two different ways: it may be actuated manually in a manual operating mode. In an automatic operating mode, the 3-phase supply voltage is measured and monitored wherein switching device 40, which is, e.g., a relay is actuated upon 3-phase power supply failure. The power supply for the measuring and monitoring procedure and the power supply of the respective control circuit is provided without power interruption by means of battery 22.

In an emergency operation, when 3-phase AC power source 3 fails, the operation device 2 is disconnected from the power source terminals L1, L2, L3 and N by opening normally closed emergency switching device 40 which is connected downstream to the power source 3, so that the elevator system is disconnected from the power source 3 in emergency operation, and normally open auxiliary operation switch 24 is closed. The output 21 of the auxiliary power supply 20 provides auxiliary output voltage VOUT of e.g. 230 V to the second tap 14 of the primary winding 11 of transformer 10. As a result, a 2-phase auxiliary supply voltage VS is provided across the taps 13 and 15 of the primary winding 11 of the transformer 10 to supply the drive device 4 to drive the motor 5 in appropriate manner. Thus, the auxiliary power supply 20 generates a stepped-up auxiliary supply voltage VS of e.g. 400 V across the terminals of the primary winding 11 via the first tapping 13-15. Thus, the 2-phase auxiliary supply voltage VS provided to the drive device 4 is higher in magnitude than the auxiliary output voltage VOUT of the auxiliary power supply 20.

Hence, the primary winding 11 of transformer 10 accomplishes dual function: in normal operation, the first tapping 13-15 (the 400 V tapping) receives via terminals L1 and L2 two phases of the 3-phase AC power source 3 and is used to generate the supply voltages V1 to V5 across the terminals of the secondary windings 12. During emergency operation, the second tap 14 (the 230 V tap) is used as an auxiliary power receiving terminal used for receiving auxiliary power, and the primary winding 11 serves to provide auxiliary supply voltage VS to drive device 4 and, in addition, to generate voltages V1 to V5 at the secondary windings during emergency operation.

According to the embodiment of FIG. 1, the elevator system 1 moreover comprises a door operating device 30 for operating a door 19 of the ln an emergency operation, when 3-phase AC power source 3 fails, the operation device 2 is disconnected from the power source terminals L1, L2, L3 and N by opening normally closed emergency switching device 40 which is connected downstream to the power source 3, so that the elevator system is disconnected from the power source 3 in emergency operation, and normally open auxiliary operation switch 24 is closed. The output 21 of the auxiliary power supply 20 provides auxiliary output voltage VOUT of e.g. 230 V to the second tap 14 of the primary winding 11 of transformer 10. As a result, a 2-phase auxiliary supply voltage VS is provided across the taps 13 and 15 of the primary winding 11 of the transformer 10 to supply the drive device 4 to drive the motor 5 in appropriate manner. Thus, the auxiliary power supply 20 generates a stepped-up auxiliary supply voltage VS of e.g. 400 V across the terminals of the primary winding 11 via the first tapping 13-15. Thus, the 2-phase auxiliary supply voltage VS provided to the drive device 4 is higher in magnitude than the auxiliary output voltage VOUT of the auxiliary power supply 20.

Hence, the primary winding 11 of transformer 10 accomplishes dual function: in normal operation, the first tapping 13-15 (the 400 V tapping) receives via terminals L1 and L2 two phases of the 3-phase AC power source 3 and is used to generate the supply voltages V1 to V5 across the terminals of the secondary windings 12. During emergency operation, the second tap 14 (the 230 V tap) is used as an auxiliary power receiving terminal used for receiving auxiliary power, and the primary winding 11 serves to provide auxiliary supply voltage VS to drive device 4 and, in addition, to generate voltages V1 to V5 at the secondary windings during emergency operation.

According to the embodiment of FIG. 1, the elevator system 1 moreover comprises a door operating device 30 for operating a door 19 of the elevator car 9. The door operating device 30 is operable at an alternating current voltage of e.g. 230 V. In normal operation of the elevator system, a first input 11 of the door operating device 30 is connected to terminal N connected to the neutral terminal of the 3-phase AC power source 3, and a second input 12 of the door operating device 30 is connected to one of the terminals L1 to L3 connected to the voltage terminals of the 3-phase AC power source 3, wherein according to the present embodiment the second input 12 of the door operating device 30 is connected to terminal L1. In emergency operation of the elevator system, the door operating device 30 is connected to the auxiliary power supply output 21 for receiving the auxiliary output voltage VOUT of the auxiliary power supply 20, and the terminal 15 of the primary winding 11 of transformer 10 is connected to the second input 12 of the door operating device 30. In particular, in emergency operation, the auxiliary power supply output 21 is connected to the first input 11 of the door operating device 30 and the terminal 15 of the primary winding 11 of transformer 10 is connected to the second input 12 of the door operating device 30. Thus, the door operating device 30 is supplied with the auxiliary output voltage VOUT of e.g. 230 V from the DC/AC inverter 23, whereas the drive device 4 is supplied with the stepped-up auxiliary supply voltage VS of e.g. 400 V via the transformer 10. For operating the door 19, the door operating device 30 outputs a control signal 31 supplied for controlling the opening or closing movement of door 19.

The inventive concept as described above can be used for automatic or manual emergency operation such as a safe rescue of passengers aboard the elevator car in case of an electrical power failure, including a balanced load situation. The described solution can be integrated into an existing elevator system design with only slight modifications of the circuit design.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

The invention claimed is:

1. An operation device for an elevator system comprising:

a plurality of terminals configured to receive AC power supply voltage from a 3-phase AC power source;

a drive device connected to the plurality of terminals for driving a motor of the elevator system, the motor causing movement of an elevator car;

a transformer connected to at least two of the plurality of terminals, the transformer providing at least one supply voltage to the remainder of the elevator system;

an auxiliary power supply having an auxiliary power supply output for providing an auxiliary output voltage;

the auxiliary power supply output being connected to the transformer in an emergency operation of the elevator system for generating an auxiliary supply voltage provided to the drive device via the transformer.

2. The operation device according to claim 1, wherein the transformer is connected to respective two of the plurality of terminals for receiving a 2-phase voltage, the auxiliary power supply output providing a 2-phase auxiliary output voltage, the auxiliary power supply output is connectable, in emergency operation of the elevator system, to the transformer for generating a 2-phase auxiliary supply voltage provided to the drive device via the transformer.

3. The operation device according to claim 1, wherein the auxiliary supply voltage provided to the drive device is higher in magnitude than the auxiliary output voltage of the auxiliary power supply.

4. The operation device according to claim 1, wherein the transformer has a primary and a secondary winding the primary winding being configured to receive power from the 3-phase AC power source and the secondary winding providing at least one supply voltage to the remainder of the elevator system, and the auxiliary power supply output being connected, in emergency operation of the elevator system, to the primary winding of the transformer for generating the auxiliary supply voltage provided to the drive device via the primary winding of the transformer.

5. The operation device according to claim 4, wherein the primary winding of the transformer has primary winding terminals providing a first tapping and a second tapping, the first tapping being adapted to be connected to the 3-phase AC power source, the auxiliary power supply output being connected, in emergency operation of the elevator system, to the second tapping for generating the auxiliary supply voltage provided to the drive device via the first tapping.

6. The operation device according to claim 5, wherein the plurality of terminals for connection to the 3-phase AC power source have a first voltage terminal, a second voltage terminal and a third voltage terminal for providing a respective AC power supply voltage, the drive device being connected to the first voltage terminal, the second voltage terminal and the third voltage terminal, the first tapping of the primary winding of the transformer being connected to the first voltage terminal and the second voltage terminal, the second tapping of the primary winding of the transformer being connected, in emergency operation of the elevator system, to the first voltage terminal and to the auxiliary power supply output for generating the auxiliary supply voltage to be provided to the drive device via the first tapping.

7. The operation device according to claim 1, wherein the auxiliary power supply comprises a battery-fed DC/AC inverter.

8. The operation device according to claim 7, wherein the DC/AC inverter provides a modified or a true sine wave output voltage.

9. The operation device according to claim 1, wherein the auxiliary power supply is designed such that the auxiliary output voltage is selectable in magnitude.

10. The operation device according to claim 1, wherein the elevator system comprises a door operating device for operating a door of an elevator car, the door operating device receiving the auxiliary output voltage of the auxiliary power supply.

11. The operation device according to claim 10, wherein the plurality of terminals for connection to the 3-phase AC power source comprise a neutral terminal for connection to a neutral pole of the 3-phase AC power source, and the door operating device, in normal operation of the elevator system, is connected to the neutral terminal and to one of the voltage terminals of the 3-phase AC power source.

12. The operation device according to claim 10, wherein the door operating device, in emergency operation of the elevator system, is connected to the auxiliary power supply output for receiving the auxiliary output voltage of the auxiliary power supply and to one of the primary winding terminals of the transformer.

13. The operation device according to claim 12, wherein, in emergency operation of the elevator system, the auxiliary power supply output is connected to the neutral terminal of the door operating device.

14. The operation device according to claim 1, comprising an emergency switching device connected downstream to the terminals for disconnecting the 3-phase AC power source from the elevator system in emergency operation.

15. The operation device according to claim 1, wherein the motor causes movement of a hoisting sheave.

16. An operation device for an elevator system, comprising:

a plurality of terminals configured to receive AC power supply voltage from a 3-phase AC power source;

a drive device connected to the plurality of terminals for driving a motor of the elevator system;

a transformer connected to at least two of the plurality of terminals, the transformer providing at least one supply voltage to a remainder of the elevator system, the transformer having a primary winding and a secondary winding, the primary winding being configured to receive power from the 3-phase AC power source and the secondary winding providing the supply voltage to the remainder of the elevator system; and an auxiliary power supply having an auxiliary power supply output for providing an auxiliary output voltage, the auxiliary power supply output being connected to the primary winding of the transformer in emergency operation of the elevator system for generating an auxiliary supply voltage provided from the primary winding of the transformer to the drive device.

17. An operation device, comprising:

a plurality of terminals configured to receive AC power supply voltage from a 3-phase AC power source;

a drive device connected to the plurality of terminals for driving a motor of the elevator system;

a transformer connected to at least two of the plurality of terminals, the transformer providing at least one supply voltage to a remainder of the elevator system; and an auxiliary power supply having an auxiliary power supply output for providing an auxiliary output voltage, the auxiliary power supply output being connected to the transformer in an emergency operation of the elevator system for generating an auxiliary supply voltage provided to the drive device via the transformer, the auxiliary power supply comprising a DC/AC inverter that provides at least one of a modified sine wave output voltage or a true sine wave output voltage.

18. An operation device, comprising:

a plurality of terminals configured to receive AC power supply voltage from a 3-phase AC power source;

a drive device connected to the plurality of terminals for driving a motor of the elevator system;

a transformer connected to at least two of the plurality of terminals, the transformer providing at least one supply voltage to a remainder of the elevator system; and an auxiliary power supply having an auxiliary power supply output for providing an auxiliary output voltage, the auxiliary power supply output being connected to the transformer in an emergency operation of the elevator system for generating an auxiliary supply voltage provided to the drive device via the transformer, the auxiliary output voltage being selectable in magnitude.

* * * * *